US008287315B2

(12) United States Patent
Montena

(10) Patent No.: US 8,287,315 B2
(45) Date of Patent: Oct. 16, 2012

(54) PHONE PLUG CONNECTOR DEVICE

(75) Inventor: Noah Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 13/231,011

(22) Filed: Sep. 13, 2011

(65) Prior Publication Data

US 2012/0003870 A1 Jan. 5, 2012

Related U.S. Application Data

(63) Continuation of application No. 12/556,500, filed on Sep. 9, 2009, now Pat. No. 8,016,615.

(51) Int. Cl.
*H01R 24/00* (2011.01)

(52) U.S. Cl. ..... 439/669; 439/580

(58) Field of Classification Search ..... 439/669, 439/578, 580

See application file for complete search history.

(56) References Cited

U.S. PATENT DOCUMENTS

| | | | |
|---|---|---|---|
| 2,238,834 | A | 4/1941 | Travers |
| 2,449,983 | A | 9/1948 | Devol |
| 2,761,110 | A | 8/1956 | Edlen et al. |
| 3,184,706 | A | 5/1965 | Atkins |
| 3,683,320 | A | 8/1972 | Woods et al. |
| 3,706,958 | A | 12/1972 | Blanchenot |
| 4,261,632 | A | 4/1981 | Narozny |
| 4,352,240 | A | 10/1982 | Komada |
| 4,374,458 | A | 2/1983 | Komada |
| 4,553,806 | A | 11/1985 | Forney, Jr. et al. |
| 4,557,546 | A | 12/1985 | Dreyer |
| 4,688,877 | A | 8/1987 | Dreyer |
| 4,789,355 | A | 12/1988 | Lee |
| 4,799,902 | A | 1/1989 | Laudig et al. |
| 5,066,248 | A | 11/1991 | Gaver, Jr. et al. |
| 5,073,129 | A | 12/1991 | Szegda |
| 5,261,839 | A | 11/1993 | Franks, Jr. |
| 5,318,458 | A | 6/1994 | Thorner |
| 5,362,251 | A | 11/1994 | Bielak |
| 5,470,257 | A | 11/1995 | Szegda |
| 5,527,190 | A | 6/1996 | Weingartner |
| 5,890,925 | A | 4/1999 | Bernardini |
| 5,997,350 | A | 12/1999 | Burris et al. |

(Continued)

FOREIGN PATENT DOCUMENTS

DE 4229812 C1 3/1994

OTHER PUBLICATIONS

U.S. Appl. No. 13/209,587, filed Aug. 15, 2011.

(Continued)

*Primary Examiner* — Ross Gushi

(74) *Attorney, Agent, or Firm* — Schmeiser, Olsen & Watts LLP

(57) ABSTRACT

A phone plug connector device having a preassembled three conductive phone plug and connector, wherein the phone plug includes a conductive tip and a stem, wherein the connector connects the phone plug to a triaxial cable, wherein the triaxial cable comprises a center conductor surrounded by a first dielectric, the first dielectric being surrounded by a first conductive sheath, and the first conductive sheath surrounded by a protective outer jacket, wherein the connector connects the triaxial cable to the phone plug mechanically and electrically by compression.

12 Claims, 10 Drawing Sheets

U.S. PATENT DOCUMENTS

| | | | | |
|---|---|---|---|---|
| 6,109,963 | A | | 8/2000 | Follingstad et al. |
| 6,116,945 | A | | 9/2000 | Davis et al. |
| 6,123,567 | A | | 9/2000 | McCarthy |
| 6,149,469 | A | * | 11/2000 | Kim ..... 439/668 |
| 6,153,830 | A | * | 11/2000 | Montena ..... 174/88 C |
| 6,179,656 | B1 | | 1/2001 | Wong |
| 6,210,222 | B1 | | 4/2001 | Langham et al. |
| 6,254,430 | B1 | | 7/2001 | Endo et al. |
| 6,261,126 | B1 | | 7/2001 | Stirling |
| 6,331,123 | B1 | | 12/2001 | Rodrigues |
| 6,517,379 | B2 | | 2/2003 | Leve |
| 6,558,194 | B2 | | 5/2003 | Montena |
| 6,568,964 | B2 | | 5/2003 | D'Addario |
| 6,575,784 | B1 | | 6/2003 | Yamada |
| 6,644,993 | B2 | | 11/2003 | Victor |
| 6,676,446 | B2 | | 1/2004 | Montena |
| 6,705,884 | B1 | | 3/2004 | McCarthy |
| 6,722,902 | B2 | | 4/2004 | Kedzierski |
| 6,729,912 | B2 | | 5/2004 | D'Addario |
| 6,749,454 | B2 | | 6/2004 | Schmidt et al. |
| 6,764,350 | B2 | | 7/2004 | Kosmala |
| 6,786,774 | B2 | | 9/2004 | Haas, II et al. |
| 6,848,940 | B2 | | 2/2005 | Montena |
| 6,860,760 | B2 | | 3/2005 | Endo et al. |
| 6,884,113 | B1 | | 4/2005 | Montena |
| 6,966,796 | B2 | | 11/2005 | Abe et al. |
| 7,029,326 | B2 | | 4/2006 | Montena |
| 7,048,579 | B2 | | 5/2006 | Montena |
| 7,121,872 | B1 | | 10/2006 | Hanks |
| 7,153,159 | B2 | | 12/2006 | Burris et al. |
| 7,156,695 | B2 | | 1/2007 | Holliday |
| D542,225 | S | | 5/2007 | Victor |
| 7,217,155 | B2 | | 5/2007 | Montena |
| 7,226,320 | B2 | | 6/2007 | Abe et al. |
| 7,311,554 | B1 | | 12/2007 | Jackson et al. |
| 7,458,849 | B2 | | 12/2008 | Rodrigues et al. |
| 7,458,851 | B2 | | 12/2008 | Montena |
| 7,476,119 | B2 | | 1/2009 | D'Addario et al. |
| 7,488,187 | B2 | | 2/2009 | Wolf |
| 7,857,643 | B2 | | 12/2010 | Dobler |
| 7,997,929 | B2 | | 8/2011 | Montena |
| 8,016,615 | B2 | | 9/2011 | Montena |
| 2003/0207620 | A1 | | 11/2003 | Haas, II et al. |
| 2003/0224658 | A1 | | 12/2003 | Koch et al. |
| 2005/0085125 | A1 | | 4/2005 | Montena |
| 2005/0164553 | A1 | | 7/2005 | Montena |
| 2006/0014425 | A1 | | 1/2006 | Montena |
| 2006/0063426 | A1 | | 3/2006 | Khemakhem et al. |
| 2006/0194474 | A1 | | 8/2006 | Montena |
| 2008/0045082 | A1 | | 2/2008 | Kuo |
| 2008/0261445 | A1 | | 10/2008 | Malloy et al. |
| 2009/0186503 | A1 | | 7/2009 | Dobler |
| 2009/0233482 | A1 | | 9/2009 | Chawgo et al. |
| 2010/0144183 | A1 | | 6/2010 | Nania et al. |
| 2010/0203760 | A1 | | 8/2010 | Montena |
| 2011/0039449 | A1 | | 2/2011 | Montena |
| 2011/0059648 | A1 | | 3/2011 | Montena |
| 2011/0059649 | A1 | | 3/2011 | Montena |
| 2011/0237110 | A1 | | 9/2011 | Montena |
| 2011/0300747 | A1 | | 12/2011 | Montena |
| 2011/0306226 | A1 | | 12/2011 | Montena |
| 2011/0306247 | A1 | | 12/2011 | Montena |
| 2012/0094521 | A1 | | 4/2012 | Montena |

OTHER PUBLICATIONS

Notice of Allowance (Mail Date May 11, 2011) for U.S. Appl. No. 12/556,500 Filing Date Sep. 9, 2009; Confirmation No. 2669.

Issue Notification (Mail Date Aug. 24, 2011) for U.S. Appl. No. 12/556,500 Filing Date Sep. 9, 2009; Confirmation No. 2669.

U.S. Appl. No. 13/157,763, filed Jun. 10, 2011.

Office Action (Mail Date May 24, 2012) for U.S. Appl. No. 13/157,763 Filing Date Jun. 10, 2011.

U.S. Appl. No. 12/955,978, filed Nov. 30, 2010; Confirmation No. 8551.

U.S. Appl. No. 13/152,431, filed Jun. 3, 2011; Confirmation No. 6856.

* cited by examiner

PHONE PLUG CONNECTOR DEVICE

CROSS REFERENCE TO RELATED APPLICATIONS

This application is a continuation of and claims priority from co-pending U.S. application Ser. No. 12/556,500 filed Sep. 9, 2009, and entitled PHONE PLUG CONNECTOR DEVICE. This application is also related to U.S. patent application Ser. No. 12/540,683, filed Aug. 13, 2009, now U.S. Pat. No. 7,997,929 issued Aug. 16, 2011, which is hereby incorporated by reference in its entirety.

TECHNICAL FIELD

Embodiments of the present invention relate generally to triaxial cable connectors, and more particularly to, compression connectors for use with phone plugs.

BACKGROUND

Currently, two-conductor tip-sleeve (TS) and three-conductor tip-ring-sleeve (TRS) audio connectors, also known as phone plugs, are widely available as part of pre-made jumper assemblies and also as field installable connector/cable kits. Pre-made assemblies are of good to excellent build quality, but are not always convenient in length. Either they are too long and create unnecessary loss in a studio set-up, or they are too short and not repairable in a live performance or road set-up. Due to the long length of the head shell of the connector, the cable will be forced to have a tight bend radius, which can be inconvenient to use. Moreover, the diameter of the head shell tends to be too bulky creating clearance problems at the point of insertion of the plug into the panel. It may not be possible to fit plugs into consecutive or adjacent slots due to the large size of each connector. Field installable connectors solve the needs of custom preparations and make it easier to repair a damaged end, but they require clumsy set-screw connections, which often become loose over time and require bulky connector bodies to house the components, or solder, which requires soldering gear, both which can be a nuisance to use.

Another problem with current connectors, factory installed or otherwise, is that the internal wire terminations are two (coaxial) or three (triaxial) individual terminals requiring non-coaxial break-out of the cable end, losing any shielding benefits of the cable conductors being coaxial.

Additionally, the standard phone plug configurations do not always provide secure ground/shield contact, often relying upon the connector being pulled to one side within the jack. There are connectors available with a spring metal ring inset in the sleeve to improve contact, but as a separate part, it can create an additional point of contact that may become corroded or become separated due to misuse.

Currently, there are available preassembled coaxial cable connectors for use with F connectors, such as axially-compressible F connectors that are used to attach a coaxial cable to another object, such as an appliance or junction, having a terminal adapted to engage the coaxial cable connector. After an end of the coaxial cable is trimmed using one of several known cable preparation techniques, the trimmed end of the coaxial cable is inserted into a back end of the connector. Then, the coaxial cable connector is axially compressed using one of several known installation tools, and the coaxial cable connector and the coaxial cable become permanently attached to each other. Although such preassembled compressible connectors are known for use with F connectors, there are no suitable preassembled compressible phone plug connectors available on the market.

U.S. Pat. No. 6,786,774 is directed to a two-conductor cable and phone plug assembly that requires assembly of components during installation. The metal band that is used to crimp the shield of the coaxial cable is a loose piece that could be easily dropped or lost.

There remains a need to provide solderless connectors for phone plugs. It would be beneficial to provide phone plug connectors for triaxial cables that continue the triaxial relationship of the three conductors inside the connector. It would be advantageous to provide phone plug connectors with reduced length to reduce strain and stress in the cable during use. It would be beneficial to improve the usability of phone plugs in narrowly spaced equipment cabinets.

SUMMARY OF THE INVENTION

It is a primary object of an embodiment of the invention to provide a phone plug connector device for a three-contact plug and triaxial cable having a phone plug and connector, wherein the phone plug and connector are configured for interference fit with each other, wherein the phone plug comprises a tip and a stem, wherein the phone plug and connector comprise a series of conductors concentrically arranged in the phone plug connector device, wherein the triaxial cable includes a center conductor surrounded by at least a first dielectric, the first dielectric being surrounded by at least a first conductive sheath, the first conductive sheath surrounded by at least a second dielectric, the second dielectric surrounded by at least a second conductive sheath and the second conductive sheath surrounded by a protective outer jacket, wherein the connector connects the triaxial cable to the phone plug mechanically and electrically by compression. The at least first and at least second conductive sheath may include one or more foil layers and one or more braided conductive sheaths. Each conductive sheath will be separated from other conductors by a dielectric layer.

According to another aspect of the three-contact phone plug connector device, the connector connects the coaxial cable to the phone plug mechanically and electrically by compression.

According to a further aspect of the three-contact phone plug connector device, the device is provided in preassembled single unit configuration. The components or parts of the phone plug and connector may be configured for an interference fit with each other or may be joined in other ways at the factory, such as by soldering or welding certain pieces together. The strength of the connection between the connector device and the cable in the present invention may be greater than the breaking strength of the cable when the cable is fastened therein. The phone plug connector device is able to withstand high stresses and strains during use, e.g., those great enough to break the cable.

According to a further aspect of the three-contact phone plug connector device, the phone plug may include a tip ring sleeve (TRS) plug, also commonly known as a stereo or balanced plug. Phone plugs are available in various sizes including quarter-inch (6.3 mm) size and in miniaturized versions (3.5 and 2.5 mm). The TRS plug is a three-contact plug.

According to another aspect of the three-contact phone plug connector device, the series of conductors include a portion of the stem of the phone plug, configured for engaging and electrically contacting the center conductor of the triaxial cable, a first conductive tubular component located in the connector for electrically contacting the at least first conductive sheath, and a second conductive tubular component for electrically contacting the at least second conductive sheath. The first conductive tubular component comprises a post, and the second conductive tubular component comprises an inner housing and an outer housing, wherein the post and inner housing couple the phone plug to the connector by interference fit.

According to yet another aspect of the three-contact phone plug connector device, the second conductive tubular component further comprises a first annular clamp axially disposed in the outer housing, the outer housing configured for interference fit with the first annular clamp and the inner housing, and the inner housing configured for interference fit with the post.

According to still another aspect of the three-contact phone plug connector device, the outer housing includes a second annular clamp axially configured for interference fit in the outer housing and proximate the inner housing.

According to yet another aspect of the three-contact phone plug connector device, the post is disposed in a portion of the outer housing and in a portion of the phone plug. The phone plug includes a tip and a stem and a first tubular insulator radially disposed on the stem. The post includes a first section, a second section and a third section. The first section, second section and third section define a first inner cavity, the first and second section disposed in the outer housing and the third section positioned radially about the first insulator on the phone plug. The second annular clamp is positioned radially about the first section of the post. The outer surface of the first section of the post and the inner surface of the second annular clamp define a first outer cavity for insertion of the first conductive sheath, wherein the first conductive sheath electrically contacts the post.

According to still a further aspect of the three-contact phone plug connector device, the second annular clamp includes a tapered outer surface and the outer housing includes an internal wall thickness of varying thickness over four sections, wherein the first section has a tapered thickness T1, the second section has a constant thickness T2, the third section has a tapered thickness T3, and the fourth section has a constant thickness T4. T1 increases in thickness from a predetermined thickness to thickness T2, wherein thickness T2 is greater than thickness T4, and wherein thickness T3 decreases in thickness from thickness T3 to thickness T4. The outer housing engages the tapered outer surface of the second clamp at a portion of the tapered thickness T3 of the third section and at a portion of the constant thickness T4 of the fourth section when the outer housing is in a first position.

According to yet another aspect of the three-contact phone plug connector device, the outer housing engages the tapered outer surface of the first clamp at a portion of the constant thickness T2 of the second section and at a portion of the tapered thickness T3 of the third section when the outer housing is in a second position, wherein axial movement of the outer housing from the first position to the second position radially compresses the first clamp for a compressed fit with the cable.

According to another aspect of the three-contact phone plug connector device, a second annular insulator is radially disposed about the second section of the post, wherein the inner housing includes a first tubular section having a first diameter D1 and a second tubular section having a second diameter D2, wherein D1 is greater than D2, wherein the first tubular section of the inner housing is radially disposed about the second insulator for an interference fit, wherein a third tubular insulator is radially disposed about the third section of the post for an interference fit, and wherein the second tubular section of the inner housing is radially disposed about the third insulator for an interference fit.

According to a further aspect of the three-contact phone plug connector device, the phone plug is insertable in a jack, wherein the second tubular section of the inner housing includes a plurality of slots therein for providing a spring fit between the phone plug and the jack.

According to yet another aspect of the three-contact phone plug connector device, the stem of the phone plug is configured to engage and electrically contact the center conductor. One example of a configuration includes the stem having a bore and a spring contact positioned in the bore for providing contact between the center conductor and the pin. Another example includes the stem having a spike configuration for making contact with a cable having a stranded center conductor.

It is another embodiment of the present invention to provide a phone plug connector device having first and second annular clamps. The first annular clamp positioned in the outer housing and the second annular clamp is radially disposed in the first annular clamp. The second annular clamp is configured for interference fit with the first annular clamp. During the installation of a cable, the outer housing is moved axially forward over the first annular clamp, causing the first annular clamp to radially compress the cable and further exert radial pressure on the second annular clamp to compress and grip the cable.

It is a further embodiment of the present invention to provide a method of mounting a three-contact phone plug connector device to a prepared terminal end of a triaxial cable having a center conductor surrounded by at least a first dielectric, the at least first dielectric being surrounded by at least a first conductive sheath, the at least first conductive sheath surrounded by at least a second dielectric, the at least second dielectric surrounded by at least a second conductive sheath, and the at least second conductive sheath is surrounded by the protective outer jacket. The method includes providing a phone plug and connector device, wherein the phone plug comprises a conductive tip and a stem, wherein the stem is configured to engage and electrically connect the stem to the center conductor. A first insulator is disposed on the stem, and a shield is disposed on the first insulator. The connector comprises a post, an inner housing, and an outer housing, wherein the post and inner housing are configured for an interference fit with the phone plug, and wherein first and second annular clamps are axially disposed in the outer housing. The outer housing is configured for interference fit with the first and second clamps and the inner housing. The inner housing is configured for interference fit with the post, wherein the post is disposed in a portion of the outer housing and in a portion of the phone plug. The post comprises a first section, a second section and a third section. The first section, second section and third section define a first inner cavity and the first and second sections are disposed in the outer housing. The second clamp is positioned radially about the first section of the post, and the outer surface of the first section of the post and the inner surface of the second clamp defines a first outer cavity for insertion of the first conductive sheath. The method further includes preparing an end of the coaxial cable by separating the center conductor and first dielectric from the first conductive sheath, separating the first conductive sheath from the second dielectric, and separating the second conductive sheath from the protective outer jacket. The method includes inserting the prepared end of the coaxial cable into the first end of the outer housing, wherein the outer housing is in a first position and advancing the cable to insert the center conductor into the stem and the first dielectric into the first inner cavity of the post, and wherein the first conductive sheath is positioned in the first outer cavity between the post and the first clamp for electrical contact with the post, wherein the second dielectric is positioned in a portion of the second annular clamp and in a portion of the first annular clamp, wherein the second conductive sheath is positioned in the first annular clamp for electrical contact with the connector and wherein the protective outer jacket is positioned in the outer housing; and moving the outer housing axially from the first position to a second position to seal and grip the second conductive sheath and the protective outer jacket.

It is another embodiment of the present invention to provide a method of mounting a phone plug connector assembly to a prepared terminal end of a triaxial cable having a center conductor surrounded by at least a first dielectric, the at least first dielectric being surrounded by at least a first conductive sheath, the at least first conductive sheath surrounded by at least a second dielectric, the at least second dielectric surrounded by at least a second conductive sheath, and the at least second conductive sheath surrounded by the protective outer jacket. The method includes providing a phone plug and connector device, wherein the phone plug comprises a conductive tip and a stem, wherein the stem is configured to engage and electrically connect the stem to the center conductor. A first insulator is disposed on the stem and a shield is disposed on the first insulator. The connector comprises a post, an inner housing, and an outer housing, wherein the post and inner housing arc configured for an interference fit with the phone plug. A first annular clamp is axially disposed in the outer housing, the outer housing configured for interference fit with the first clamp and a second annular clamp axially disposed in the first annular clamp, the second annular clamp configured for interference fit with the first annular clamp, wherein the post is disposed in a portion of the outer housing and in a portion of the phone plug. The post comprises a first section, a second section and a third section, the first section, second section and third section define a first inner cavity. The first and second sections of the post are disposed in the outer housing, wherein the second clamp is positioned radially about the first section of the post. The outer surface of the first section of the post and the inner surface of the second clamp define a first outer cavity for insertion of the first conductive sheath. The method further includes preparing an end of the coaxial cable by separating the center conductor and first dielectric from the first conductive sheath, separating the first conductive sheath from the second dielectric, separating the second conductive sheath from the protective outer jacket. The next step includes inserting the prepared end of the coaxial cable into the first end of the outer housing, wherein the outer housing is in a first position and advancing the cable to position the center conductor into the stem and the first dielectric into the first inner cavity of the post, wherein the first conductive sheath is positioned in the first outer cavity between the post and the first clamp for electrical contact with the post, wherein the second dielectric is positioned in a portion of the second annular clamp and in a portion of the first annular clamp, wherein the second conductive sheath is positioned in the first annular clamp for electrical contact with the connector and wherein the protective outer jacket is positioned in the outer housing. The next step includes moving the outer housing axially from the first position to a second position to seal and grip the second conductive sheath and the protective outer jacket.

The phone plug connector device provides electromagnetic shielding throughout the length of the connector device to prevent noise and signal interference of external or environmental conductors from affecting either the signal on the center wire or on the second signal conductor, e.g., first conductive sheath. Moreover, the outermost conductor, e.g., the second conductive sheath prevents the signal from the center wire and second signal conductor from radiating outside the connector.

BRIEF DESCRIPTION OF THE DRAWINGS

Embodiments of the present invention will be more fully understood and appreciated by reading the following Detailed Description in conjunction with the accompanying drawings, in which.

DETAILED DESCRIPTION

"Present invention" means at least some embodiments of the present invention; references to various feature(s) of the "present invention" throughout this document do not mean that all claimed embodiments or methods include the referenced feature(s).

Figure 1:
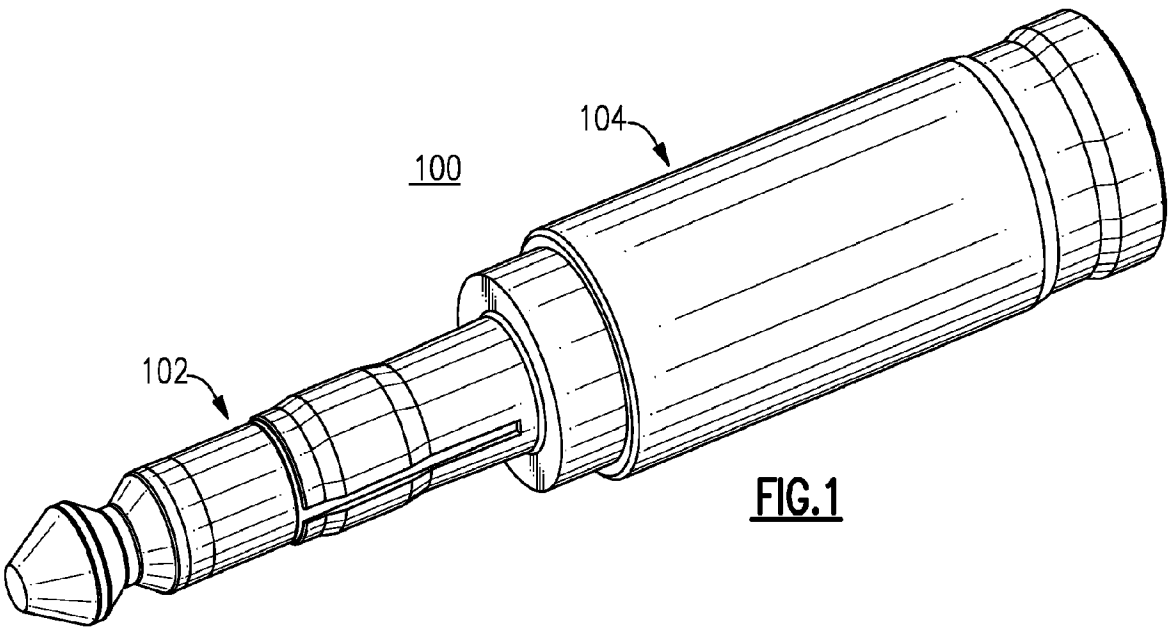
FIG. 1 is a perspective view of an embodiment of a phone plug connector device of the present invention.

As will be appreciated, an embodiment of the present invention provides a three-conductor phone plug connector device 100 as shown in FIG. 1. Phone connector device 100 includes a phone plug 102 and a connector 104. Device 100 is preferably provided as a preassembled configuration to ease handling and installation during use.

Figure 2:
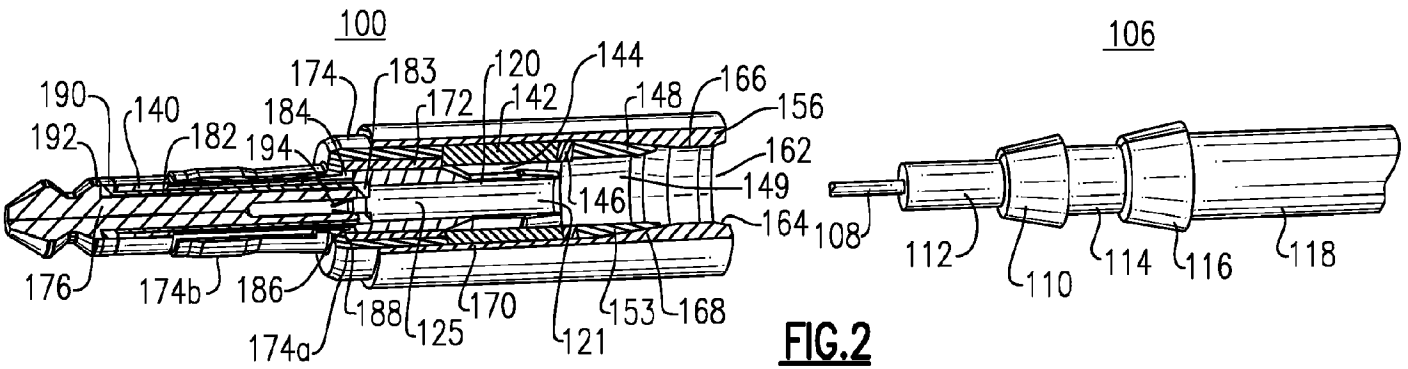
FIG. 2 is a sectional view of the phone plug connector device of FIG. 1 shown with a triaxial cable.

Connector 104 connects phone plug 102 to a triaxial cable 106 shown in FIG. 2 by means of compression without the need for soldering, crimping or tooling. Triaxial cable 106 can be of known type having an electrical center conductor 108 surrounded by and spaced radially inwardly from a first braid conductor or first conductive sheath 110 by a first dielectric material or an insulator core 112. A second dielectric or insulator core material 114 separates first sheath 110 from a second braid conductor or second conductive sheath 116. A dielectric covering or sheathing jacket 118 surrounds conductive sheath 116 and includes the outermost layer of the cable. The triaxial cable used herein is not limited to that just described and any form of triaxial cable (e.g., cables having sheathing layers composed of multiple or variable layers of sheathing materials, stranded central conductors, dielectric materials of varying thickness, etc.) may be used.

The type of compression used in connector 104 may be any form including but not limited to configurations set forth in U.S. Pat. Nos. 6,558,194, 6,153,830, 5,470,257, and 6,261,126, all of which are hereby incorporated by reference. It is important that the compression configuration used herein is easily assembled and may be preassembled and already connected to phone plug 102 as a single or unitary configuration prior to installation. Connector 114 includes a number of components that fit, press or snap together without the need for soldering or crimping. The shape and configuration of the components or pieces that make up connector 114 may vary depending upon the way the pieces fit together.

It is preferable that the components of the embodiments of the device of the present invention fit together by interference fit or compression, which can be achieved by friction after the parts are pushed together rather than by other means of fastening. "Interference" refers to the fact that one part slightly interferes with the spatial location of another, and commonly includes arrangements referred to as a press fit.

FIGS. 1 through 8 illustrate but one example of a configuration used herein to create connector device 100. Connector 104 is configured to accommodate receiving the prepared end of a triaxial cable. Connector 104 includes a post or tubular body 120 for receiving a triaxial cable. Prior to insertion into post 120, the triaxial cable is prepared by removing various layers, as known in the art, to expose an end of center conductor 108, first dielectric material 112, first conductive sheath 110, second dielectric material 114 and second conductive sheath 116, which is folded over sheathing jacket 118.

Figure 3:
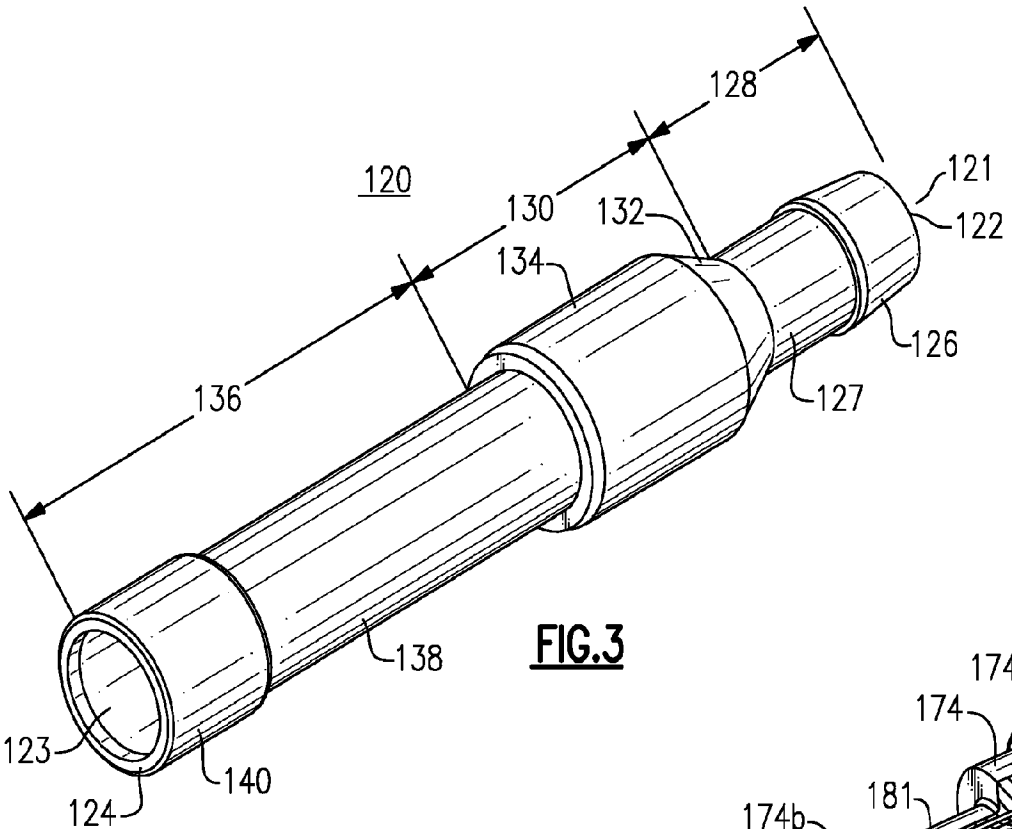
FIG. 3 is a perspective view of the post in the phone plug connector device of FIG. 1.
Figure 4:
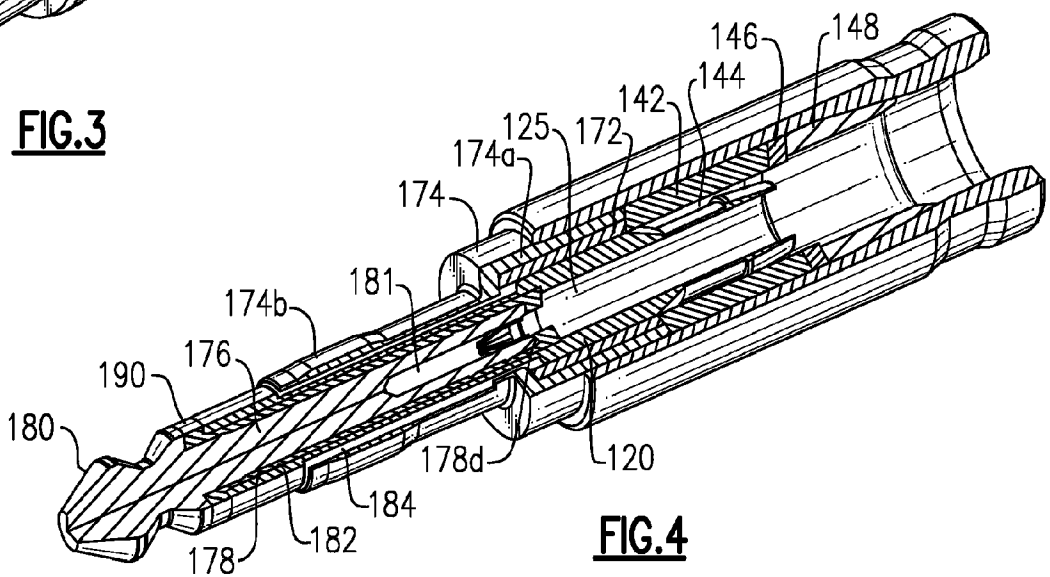
FIG. 4 is a sectional view of the phone plug connector device of FIG. 1.
Figure 5:
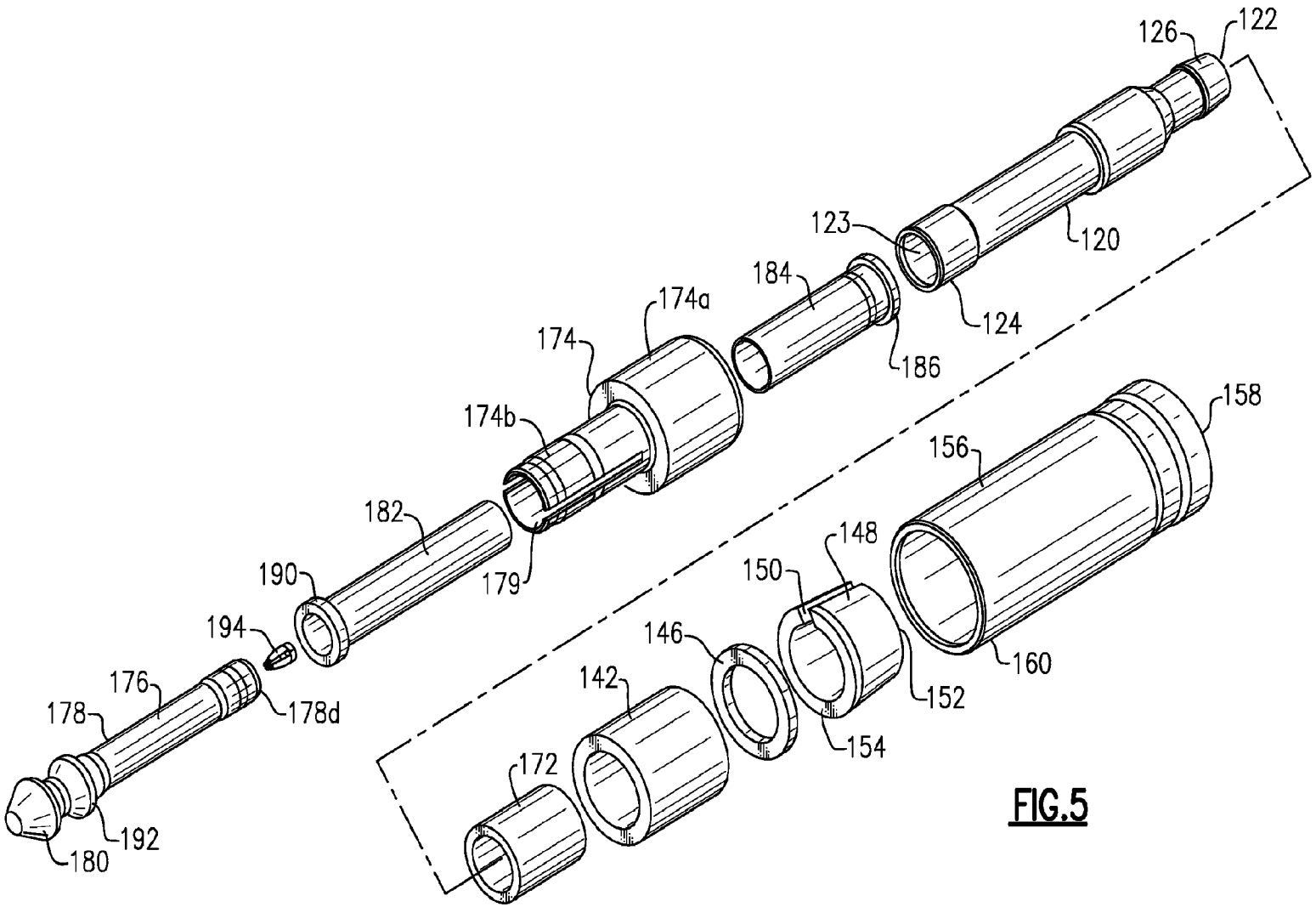
FIG. 5 is an exploded perspective view of the phone plug connector device of FIG. 1.

Post 120 has a first opening 121 at a first end 122 and a second opening 123 at second end 124, which defines a first inner cavity 125. Reference is hereby made to FIG. 3 which shows post 120 divided into sections. The first section 128 extends from first end 122 and a flange or raised lip 126 is disposed proximate first end 122 of the outer surface of post 120. First section 128 has a tubular section 127 of constant diameter extending from flange 126 to the end of first section 128. The second section 130 includes tapered section 132 and raised annular or tubular section 134. The third section 136 includes a long tubular section 138 and a raised lip or flange 140 proximate the second end 124 of post 120.

Connector 104 includes an outer housing 156 and an inner housing 174. Connector 104 further includes a first fastener or annular clamp 148 and a second fastener or annular clamp 142 radially disposed in outer housing 156. Second annular clamp 142 is radially spaced about post 120 to define a first outer cavity 144. Post 120 receives the center conductor 108 and the first dielectric 112 of triaxial cable 106. The first sheath 110 and a portion of the second dielectric 114 are received in the first outer cavity 144 between post 120 and clamp 142. It is preferable that clamp 142 is a nonconductive material such as an elastomeric material to prevent contact with other conductive pieces in connector 104.

A washer 146 is sandwiched between second annular clamp 142 and first annular clamp 148 to prevent contact between first clamp 142 and second clamp 148. First clamp 148 includes a slot or opening 150 therein to provide a radially flexible ring, such as a slotted, split or notched ring, to provide flexibility and compression with respect to an outer housing 156. Clamp 148 includes a taper on the outer surface creating a smaller diameter at a first end 152 and a larger diameter at second end 154. Outer housing 156 is a longitudinally extending tubular housing having a first end 158 and a second end 160, which define a second inner cavity 162. The inner wall of housing 156 tapers inwardly a short distance providing a first taper 164 decreasing the diameter of cavity 162. Following first taper 164, the inner wall of housing 156 is constant a short distance at 166. Thereafter, the inner wall of housing 156 tapers outwardly a short distance providing a second taper 168, increasing the diameter of cavity 162. Following second taper 168, inner wall of housing 156 exhibits a constant thickness at 170 for the remainder of the length of outer housing 156. The tapered configuration of clamp 148 cooperatively interacts with taper 164 of outer housing 156.

Outer housing 156 is compression fit about clamp 148, washer 146, clamp 142, and inner housing 174. An insulator 172 is positioned radially about second section 130 of post 120. Clamp 142 positioned about first section 128 and a portion of second section 130 of post 120 along with insulator 172 prevent contact between post 120 and outer housing 156. Inner housing 174 is positioned radially about insulator 172 and the outer surface of inner housing 174 is engaged with the inner surface of outer housing 156 by an interference or press fit. Raised annular section 134 of post 120 aids in the compression fit of insulator 172, inner housing 174 and outer housing 156.

Figure 7:
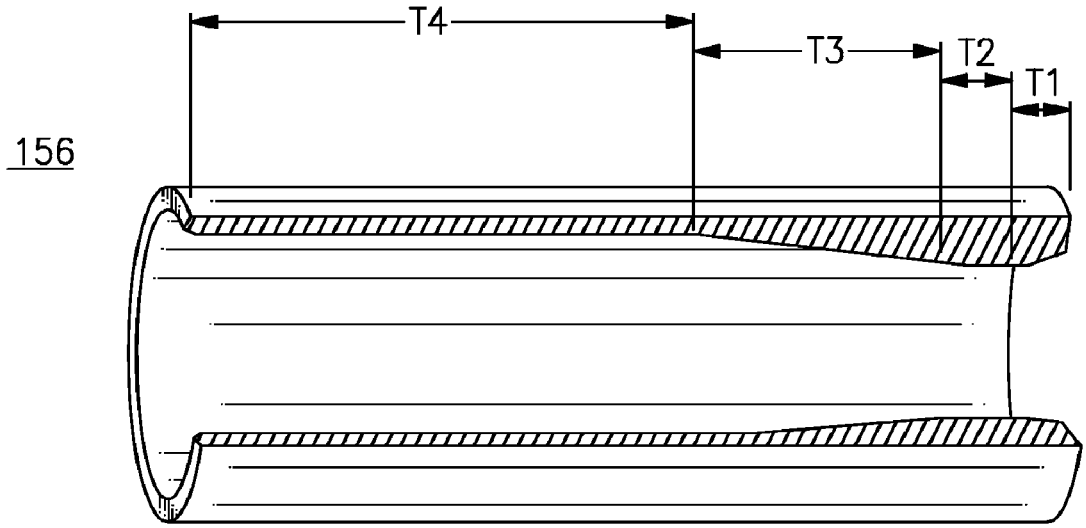
FIG. 7 is a sectional view of the outer housing of the phone plug connection device of FIG. 1.

Reference is made to FIG. 7, which shows outer housing 156 showing an internal wall thickness of varying thickness over four sections, wherein the first section has a tapered thickness T1, the second section has a constant thickness T2, the third section has a tapered thickness T3, and the fourth section has a constant thickness T4. T1 increases in thickness from a predetermined thickness to thickness T2, wherein thickness T2 is greater than thickness T4, and wherein thickness T3 decreases in thickness from thickness T2 to thickness T4. Accordingly, the outer housing 156 engages the tapered outer surface of the first clamp 148 at tapered thickness T3 and at constant thickness T4 when the outer housing 156 is in a first position.

Figure 8:
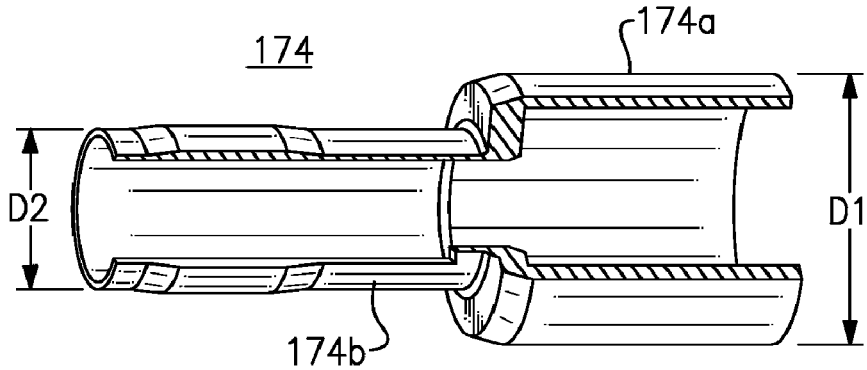
FIG. 8 is a sectional view of the inner housing of the phone plug connection device of FIG. 1.
Figure 9:
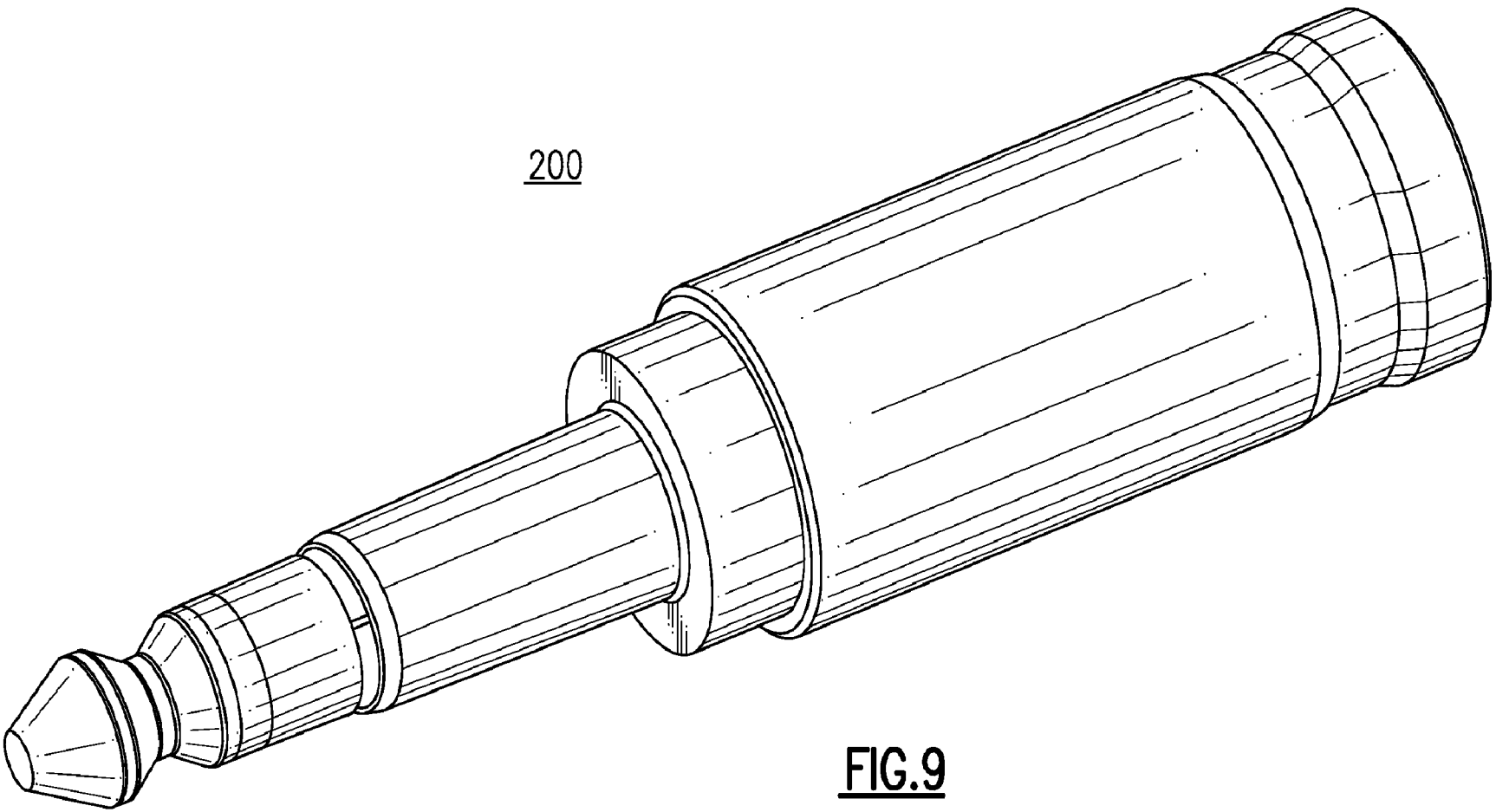
FIG. 9 is a perspective view of another embodiment of a phone plug connector device of the present invention.
Figure 10:
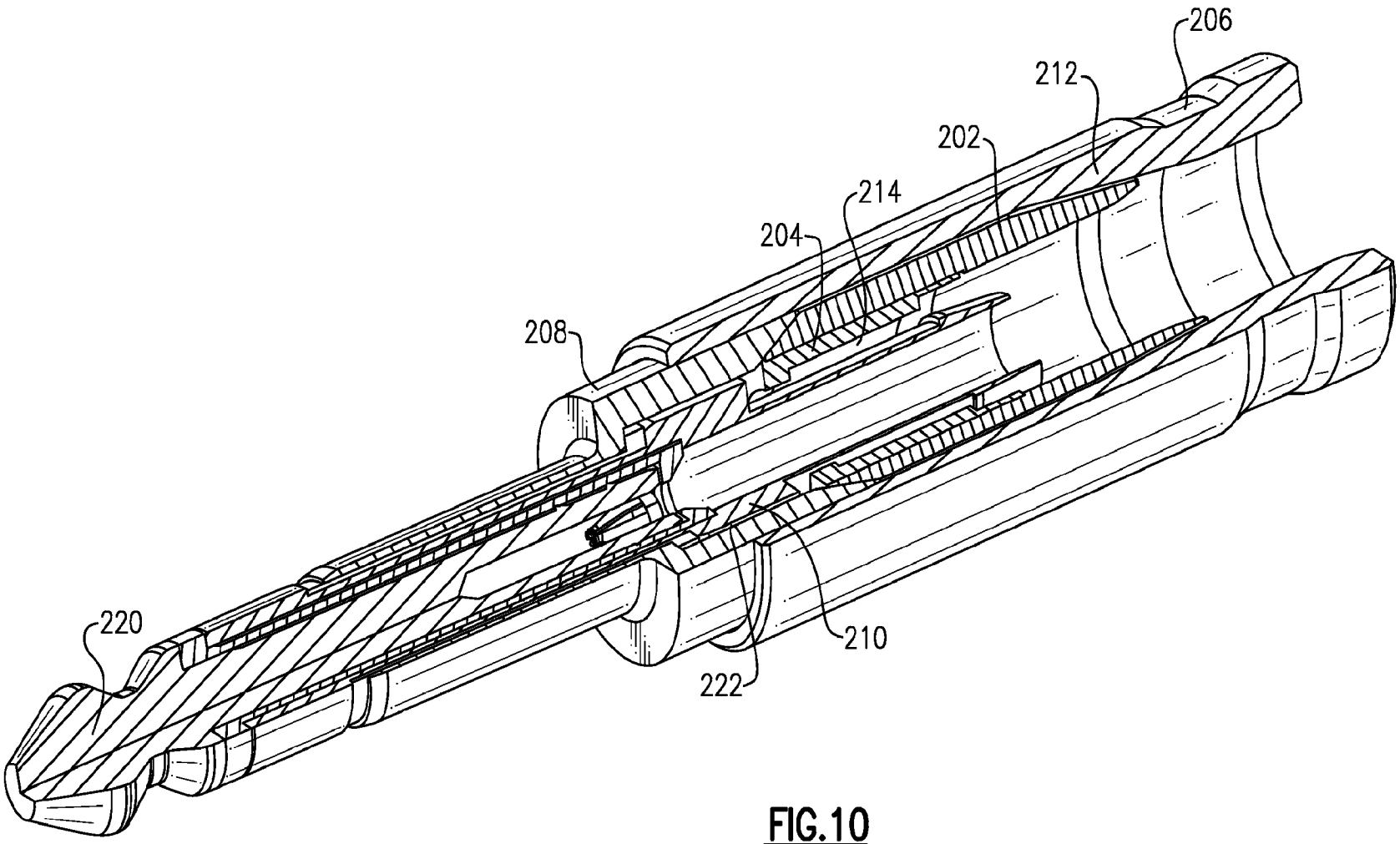
FIG. 10 is a sectional view of the phone plug connector device of FIG. 9.
Figure 11:
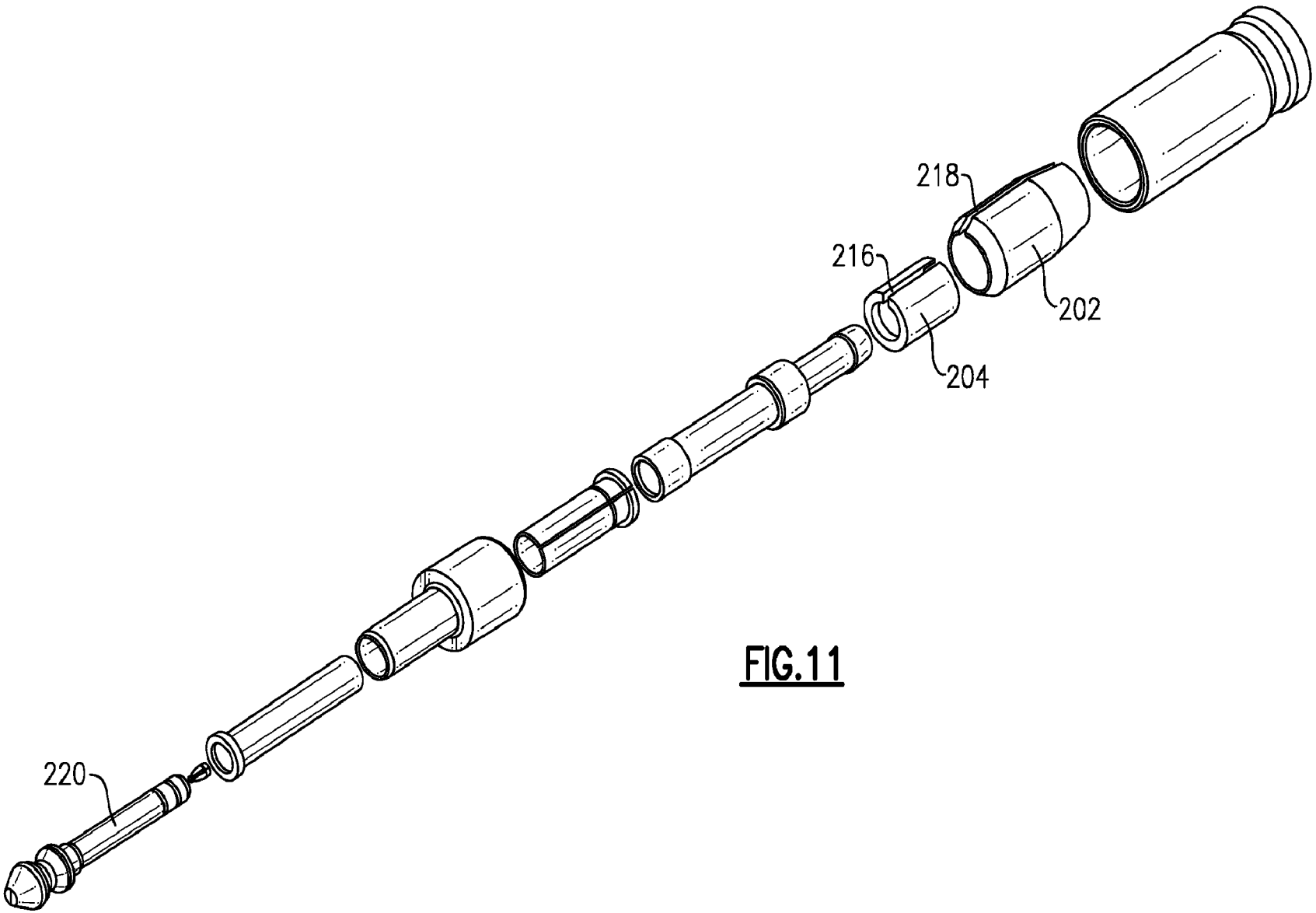
FIG. 11 is an exploded perspective view of the phone plug connector device of FIG. 10.

Reference is made to FIG. 8, which shows inner housing 174 having a first tubular section 174*a* of a first, larger diameter D1, which fits within housing 156 as described above and a second tubular section 174*b* of a second smaller diameter D2, which encases a portion of the shaft or stem 176 of pin 178 of phone plug 102. In addition to stem 176, pin 178 includes a tip 180. A portion of stem 176 is configured to engage and electrically contact the center conductor of the triaxial cable. One example of such configuration includes, but is not limited to, a bore 181 formed in the center of stem 176 of pin 178 extending from the distal end 178*d* to a point about one-third or one-half the length of stem 176 for positioning of a central conductor of a triaxial cable. A spring contact may further be included in the bore to electrically connect the stem to the conductor, as further discussed below.

An insulator 182 is positioned about stem 176 of pin 178. Third section 136 of post 120 is radially positioned about insulator 182 and an insulator 184 is radially positioned about post 120 to separate post 120 from tubular section 174*b* of inner housing 174. Insulator 184 includes a raised lip or flange 186, which engages the inner rim 188 of inner housing 174. Insulator 182 includes a raised lip or flange 190 on an end thereof, which abuts a flange 192 on one side and flange 140 of post 120 on the other side. Insulator 182 further includes an internal lip 183, which fits against end 178*d* of stem 176 of pin 178. Inner housing 174 with sections 174*a* and 174*b* further encase the components (insulator 172 and insulator 184) located in cavity 179 of inner housing 174 by an interference fit. A spring contact 194 is positioned in bore 181 of pin 178 near distal end 178*d* to provide electrical contact between pin 178 and central conductor 108, when in use, although the embodiments of the present invention are not limited to this form of electrical conductor, as discussed above. Section 174*b* of inner housing 174 may optionally include slits 183 extending longitudinally thereon to further assist in maintaining phone plug 102 in a jack when in use. Slits 183 provide resilient spring contact with a jack into which phone plug 102 is inserted.

Figure 6:
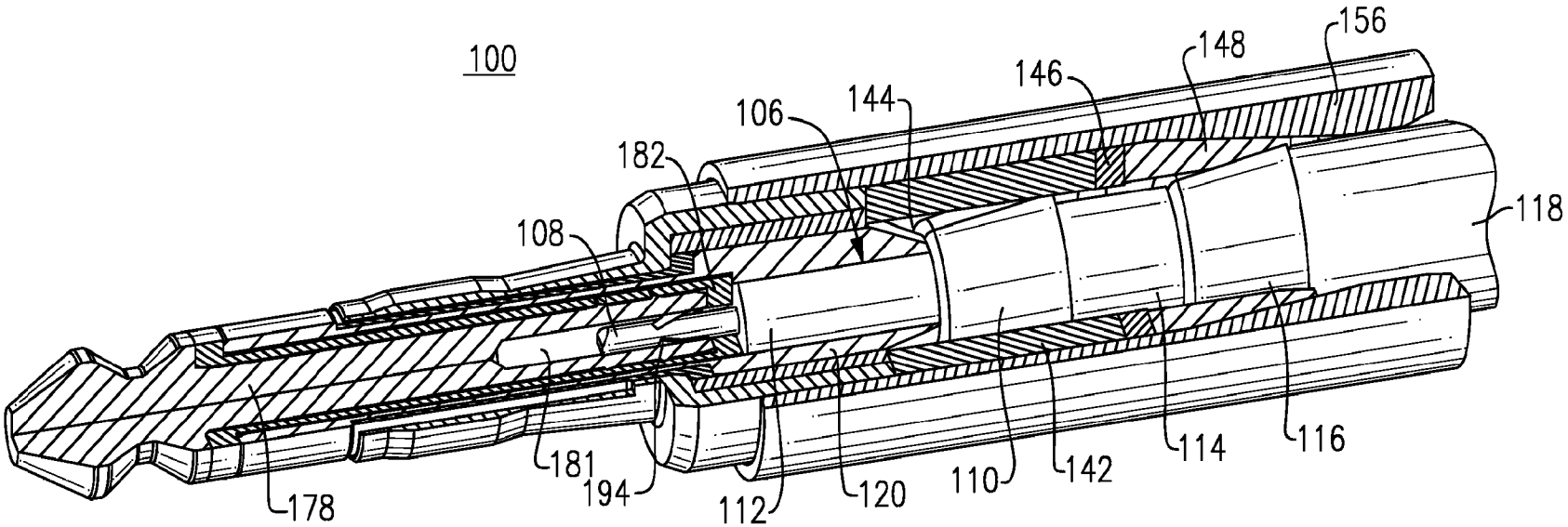
FIG. 6 is a sectional view of the phone plug connector device of FIG. 1 with a triaxial cable positioned therein.

Reference is made to FIG. 6, which shows triaxial cable 106 positioned in phone plug connector device 100. Central conductor 108 is positioned in channel 181 in contact with spring 194 and pin 178. First dielectric material 112 is positioned in middle or second section 130 of post 120 and abuts insulator 182. First conductive sheath 110 is positioned in first outer cavity 144 defined between outer surface of post 120 and inner surface of clamp 142. Second annular clamp 142 creates a radial force about first conductive sheath 110, which is sandwiched between clamp 142 and post 120 to cause conductive sheath 110 to make firm contact with post 120 to establish conduction. Raised flange 126 on the outer surface of post 120 further aids in the retention of first conductive sheath 110 of triaxial cable 106. Clamp 142 provides insulation between conductive sheath 110 and outer housing 156.

Second dielectric material 114 is positioned in a portion of second annular clamp 142, washer 146 and in a portion of first annular clamp 148. Second conductive sheath 116 is positioned in first annular clamp 148. First annular clamp 148 is fabricated of a conductive material such as brass and provides electrical contact with conductive sheath 116 to establish conduction. Sheathing jacket 118 is positioned in outer housing 156. FIGS. 1, 2, 4 and 6 show outer housing 156 in preassembled or first position. Outer housing 156 is the only component that is adjustable. All other components are fixed in place by a radial compression or interference fit. After placement of triaxial cable 106 therein, outer housing 156 may be moved forward toward pin 178 to provide an optimal compression fit between connector device 100 and triaxial cable 106. Accordingly, electrical connection or conduction is made by compression between pin 178 and triaxial cable 106 through spring 194 and central conductor 108; by first conductive sheath 110 and post 120; and by second conductive sheath 116 and first annular clamp 148.

Post 120, second annular clamp 148, outer housing 156, and inner housing 174 are fabricated of a conductive material such as metal, such as a copper alloy, or other suitable material. It is preferred that brass is used to provide good conductivity and good machinability while maintaining strength.

In a pre-installed first configuration as illustrated in FIG. 1, outer housing 156 is fastened onto inner housing 174 by an interference fit and further engaged with first annular clamp 148 by taper 153 of clamp 148 and taper 168 of outer housing 156, and second annular clamp 142. Inner housing 174 is securely engaged with post 120 by an interference fit, having insulator 172 sandwiched therebetween and is further engaged with phone plug 102 by interference fit between tubular end 174*b* of inner housing 174 and third section 136 of post 120 with insulator 184 sandwiched therebetween. Post 120 is engaged with phone plug 102 by interference fit between stem 176 of pin 178 and third section 136 of post 120 with insulator 182 therebetween. FIGS. 1, 2, 4 and 6 show device 100 in preassembled position. First and second clamps 148 and 142, respectively, and inner housing 174 are gripped by outer housing 156 to affect a slight decrease in volumes of first outer cavity 144 and second inner cavity 149. In this manner, outer housing 156, in its pre-installed first configuration, is securely fastened to first and second clamps 148 and 142, respectively, and inner housing 174 and is thus in an assembled state during storage, handling, and installation on a cable end. This eliminates any danger of any of the components being dropped or otherwise mishandled during handling and installation as is prevalent in known designs and further provides ease of installation of a cable therein.

A method of positioning the connector on a coaxial cable is now described with reference to FIG. 6. Phone plug 102 is already preassembled and already positioned in connector 104. The end of triaxial cable 106 is prepared by exposing a central core portion including the center conductor 108 and first dielectric material 112. First conductive sheath 110 is folded over second dielectric material 114. Second conductive sheath 116 is folded over outer sheath jacket 118. The prepared end of the coaxial cable can be inserted through the first end 158 of outer housing 156 such that the central core portion including the center conductor 108 and first dielectric material 112 is inserted into the inner cavity 125 of middle section 130 of post 120. Center conductor 108 is inserted in socket 194 located in bore 181 of pin 176 to provide contact between cable 106 and pin 176. First dielectric material stops in post 120 at insulator 182. First conductive sheath 110 folded over second dielectric material 114 is received in first outer cavity 144 and makes contact with post 120 by radial compression of clamp 142 thereon. Second conductive sheath 116 folded over outer sheath jacket 118 is received in the second inner cavity 149 through opening 162 of outer housing 156.

Once cable 106 is in place, outer housing 156 is then advanced or moved axially from its pre-installed first configuration to its second configuration by a tool, such as an axial compression tool, to radially compress annular clamp 148, which is the third contact with triaxial cable 106. As a result, cable 106 is firmly gripped or clamped in connector 104 by axial compression created by the interference fit between all the components. The need for additional tools or loose components is avoided with the plug connector device of the present invention.

FIGS. 9 through 12 show another embodiment of the present invention, Phone plug connector device 200 is similar to device 100, except for clamping components 202 and 204. Due to the configuration of clamping components 202 and 204, there is no need for insulator 172 and washer 146, as shown in the embodiment of FIGS. 1 through 6. Component 202 is a first annular clamp and component 202 is a second annular clamp. First annular clamp 202 is axially disposed in the outer housing 206, the outer housing 206 configured for interference fit with the first annular clamp 202 and the inner housing 208, the inner housing 208 configured for interference fit with the post 210. The tapered configuration of first annular clamp 202 cooperatively interacts with taper 212 of outer housing 206.

The second annular clamp 204 is radially disposed in the first annular clamp 202 and positioned radially about a first section of the post 210. Second annular clamp 204 is radially spaced about post 210 to define a first outer cavity 214. It is preferable that clamp 204 is fabricated of a nonconductive material such as an elastomeric material to prevent contact with other conductive pieces in connector device 200.

In order to provide flexibility and compression with respect to outer housing 206, first annular clamp 202 may each include a slot or opening 216. A split, slotted or notched clamp are other non-limiting examples useful herein or clamp 202. Likewise, second annular clamp 204 may include a slot or opening 218 or be provided as a split, slotted or notched clamp in order to provide flexibility and compression with respect to first annular clamp 202. Moreover, the flexibility of clamps 202 and 204 allow compression with and engagement of a cable inserted into connector device 200 when outer housing 206 is advanced axially forward toward phone plug 220.

Figure 12:
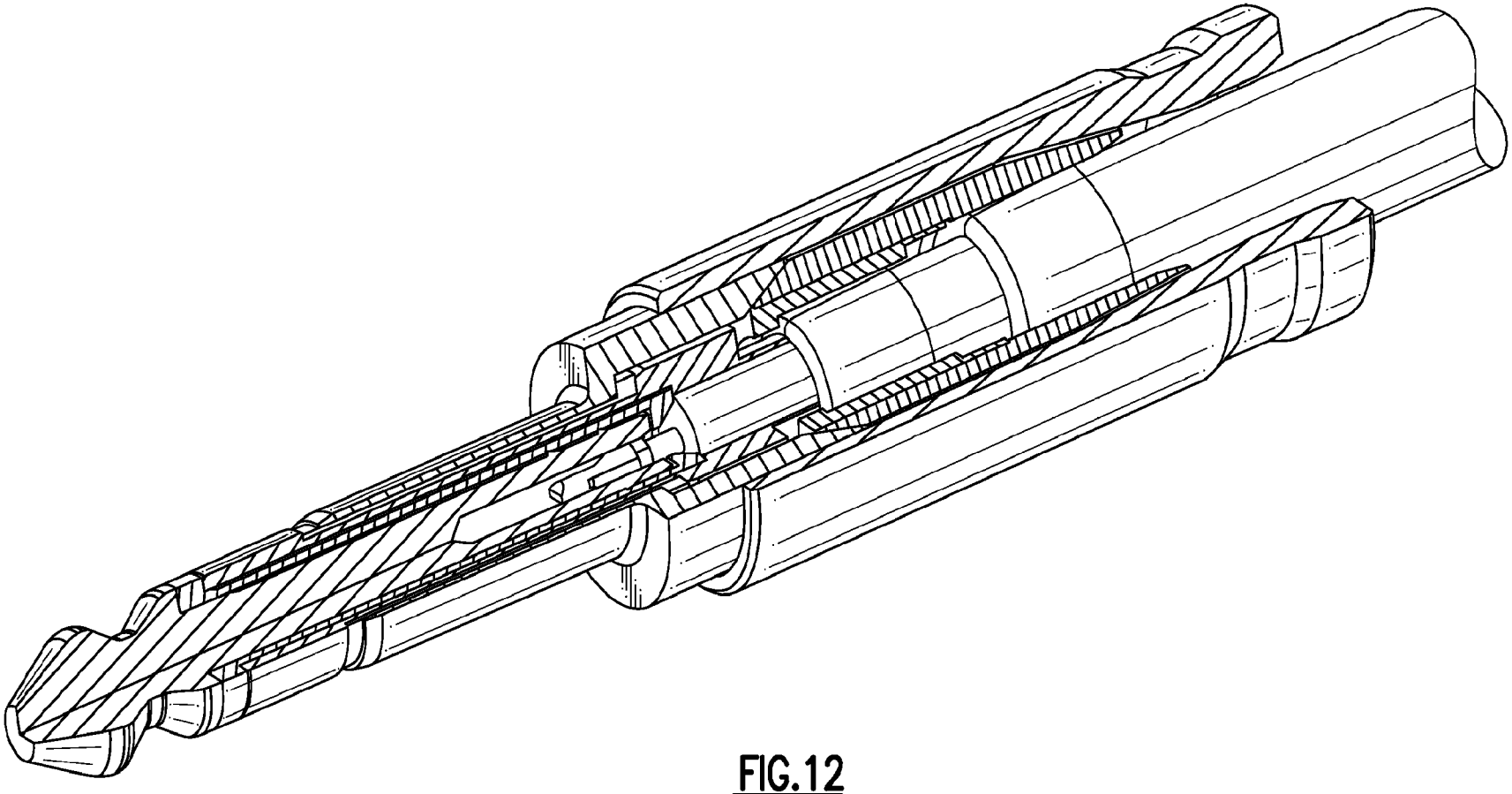
FIG. 12 is a sectional view of the phone plug connector device of FIG. 9 with a triaxial cable positioned therein.

There is no need for an insulator in this configuration as insulator 172 used in device 100 since there is an air gap 222 between post 210 and inner housing 208, which provides insulation between the two components. The remainder of the components in device 200 are similar to or the same as the components of device 100 and fit together similarly to or the same as the components in device 100 as well as with a cable inserted into connector 200 as shown in FIG. 12.

Figure 13:
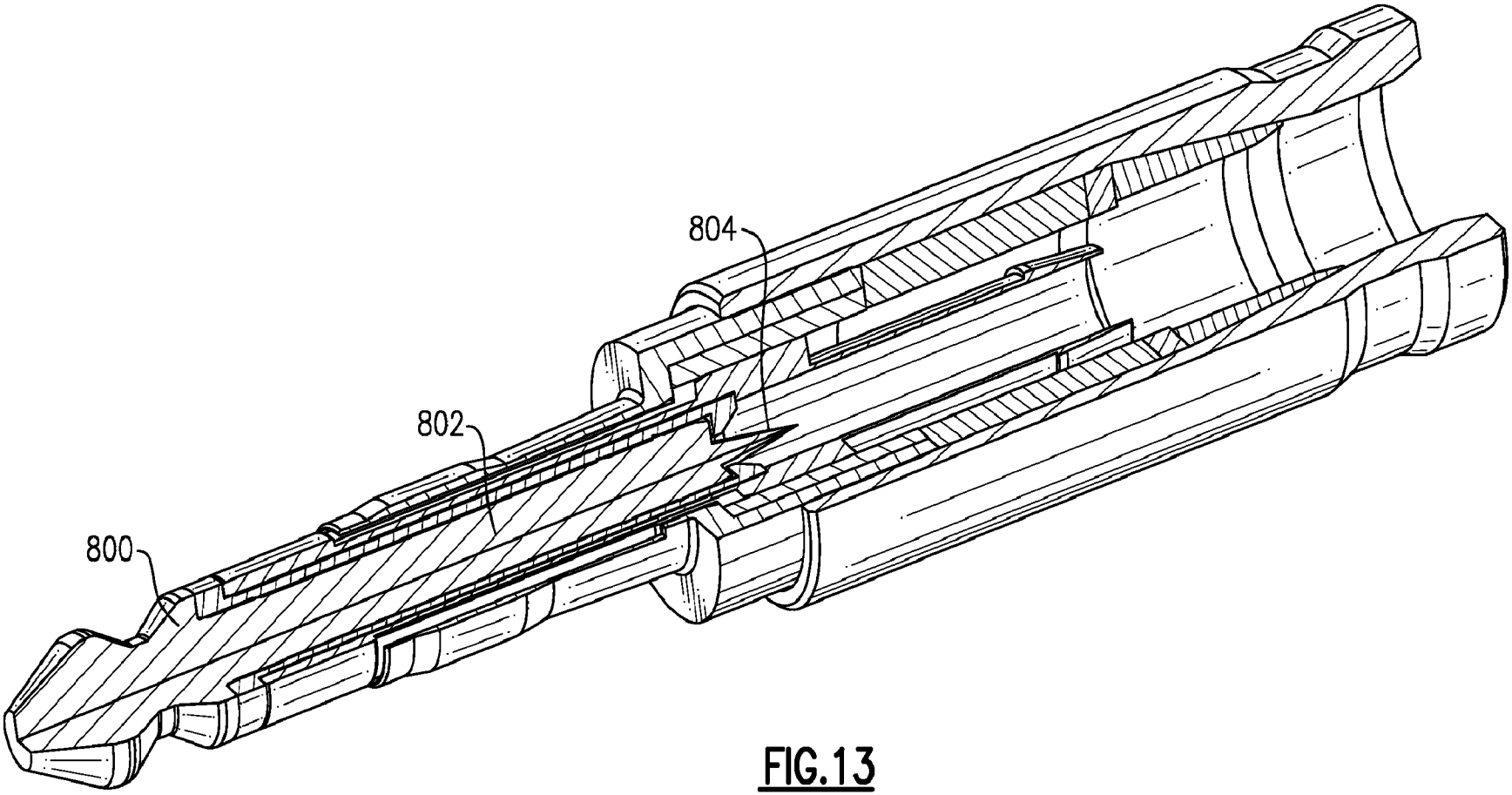
FIG. 13 is a sectional view of another embodiment of a phone plug connector device of the present invention.

Reference is made to FIG. 13, which shows another example of a contact component for making electrical contact with a center conductor. A pin 800 is shown having a stem 802. Stem 802 includes a spiked contact 804 extending from stem 802. Spiked contact 804 is able to pierce a cable and make contact with a center conductor having a plurality of strands acting as the center conductor instead of a single central wire. The present invention is not limited to a specific type of contact, as discussed above.

The strength of the connection between the cable and the connector devices described herein is very good, and may be greater than the breaking strength of the cable itself Accordingly, the connector devices are able to withstand high stresses and strains during use, e.g., those great enough to break the cable. The cable will typically fail or break before the connector device.

Moreover, it is important to mention that the embodiments of the present invention provide a device having a series of conductors concentrically arranged in the device. A portion in the stem is considered a first conductor, making contact with the center conductor of the cable. The second conductor, a first conductive tubular component is formed by the post, making electrical contact with the first conductive sheath of the cable. The third conductor, the second conductive tubular component is formed by the inner housing, outer housing and first clamp, makes contact with the second conductive sheath. This third conductor may provide a protective electromagnetic shield extending 360° the full length of the connector, providing a continuous shield from electrical interference from the shield (174) on the phone plug to the second conductive sheath (116). Additionally, the preassembled unitary construction of the devices prevent loss or mishandling of components during installation.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A phone plug connector device comprising:

a phone plug and connector provided in a preassembled single unit configuration;

wherein the phone plug and connector comprise a series of conductors arranged in the phone plug connector device to make electrical connection with respective conductors of a multi-conductor cable, the connector configured to receive a prepared end of the multi-conductor cable when the connector is in a first pre-installed configuration; and wherein, as a result of axial compression from the first pre-installed configuration to a second compressed configuration, the phone plug connector device connects with the multi-conductor cable in such a manner so as to electrically connect the series of conductors with the respective conductors of the multi-conductor cable and securely mechanically retain the prepared end of the cable as connected within the phone plug connector device;

wherein the phone plug comprises a tip ring sleeve (TRS) plug.

2. The phone plug connector device of claim 1, wherein the plug and connector are configured to axially connect with conductors of a tri-axial multi-conductor cable.

3. The phone plug connector device of claim 1 wherein the strength of the connection between the connector device and the cable is greater than the breaking strength of the cable when the cable is fastened therein.

4. The phone plug connector device of claim 1 wherein the phone plug comprises a conductive tip and a stem, wherein the series of conductors comprise:

a portion of the stem of the phone plug configured for engaging and electrically contacting the center conductor of the multi-conductor cable;

a first conductive tubular component located in the connector for electrically contacting at least a first conductor of the cable; and a second conductive tubular component for electrically contacting at least a second conductor of the cable.

5. The phone plug connector device of claim 1, wherein the phone plug is insertable in a jack, wherein a tubular section of an inner housing comprises a plurality of slots therein for providing a spring fit between the phone plug and the jack.

6. A phone plug connector device comprising a phone plug and connector provided in a preassembled single unit configuration;

wherein the phone plug and connector comprise a series of conductors arranged in the phone plug connector device to make electrical connection with respective conductors of a multi-conductor cable, the connector configured to receive a prepared end of the multi-conductor cable when the connector is in a first pre-installed configuration, wherein the series of conductors includes a portion of a stem of the phone plug configured for engaging and electrically contacting the center conductor of the multi-conductor cable and a first conductive tubular component located in the connector for electrically contacting at least a first conductor of the cable; and means for connecting the series of conductors of the phone plug and connector with the respective conductors of the multi-conductor cable by axial compression to form an interference fit between components of the phone plug connector device and the cable;

wherein the phone plug comprises a tip ring sleeve (TRS) plug.

7. A method connecting a multi-conductor cable to a phone plug connector device, the method comprising:

providing a phone plug connector device comprising:

a phone plug and connector provided in a preassembled single unit configuration, wherein the phone plug comprises a tip ring sleeve (TRS) plug;

wherein the phone plug and connector comprise a series of conductors arranged in the phone plug connector device to make electrical connection with respective conductors of a multi-conductor cable, the connector configured to receive a prepared end of the multi-conductor cable when the connector is in a first pre-installed configuration, wherein the series of conductors includes a portion of a stem of the phone plug configured for engaging and electrically contacting the center conductor of the multi-conductor cable and a first conductive tubular component located in the connector for electrically contacting at least a first conductor of the cable; and wherein, as a result of compression from the first pre-installed configuration to a second compressed configuration, the phone plug connector device connects with the multi-conductor cable in such a manner so as to electrically connect the series of conductors with the respective conductors of the multi-conductor cable and securely mechanically retain the prepared end of the cable as connected within the phone plug connector device;

inserting a prepared end of the coaxial cable into the connector;

compressing the phone plug connector device from the first pre-installed configuration to the second compressed configuration to electrically connect the series of conductors of the phone plug connector device with the respective conductors of the multi-conductor cable and form a mechanically secure interference fit between components of the phone plug connector device and the cable.

8. A phone plug connector device comprising:

a phone plug and connector provided in a preassembled single unit configuration, wherein the phone plug comprises a tip ring sleeve (TRS) plug;

wherein the phone plug and connector comprise a series of conductors arranged in the phone plug connector device to make electrical connection with respective conductors of a multi-conductor cable, the connector configured to receive a prepared end of the multi-conductor cable when the connector is in a first pre-installed configuration, wherein the series of conductors includes a portion of a stem of the phone plug configured for engaging and electrically contacting the center conductor of the multi-conductor cable and a first conductive tubular component located in the connector for electrically contacting at least a first conductor of the cable; and wherein, as a result of axial compression from the first pre-installed configuration to a second compressed configuration, the phone plug connector device connects with the multi-conductor cable in such a manner so as to electrically connect the series of conductors with the respective conductors of the multi-conductor cable and securely mechanically retain the prepared end of the cable as connected within the phone plug connector device.

9. The phone plug connector device of claim 8, wherein the plug and connector are configured to axially connect with conductors of a tri-axial multi-conductor cable.

10. The phone plug connector device of claim 8, wherein the strength of the connection between the connector device and the cable is greater than the breaking strength of the cable when the cable is fastened therein.

11. The phone plug connector device of claim 8, wherein the series of conductors further comprises a second conductive tubular component for electrically contacting at least a second conductor of the cable.

12. The phone plug connector device of claim 8, wherein the phone plug is insertable in a jack, wherein a tubular section of an inner housing comprises a plurality of slots therein for providing a spring fit between the phone plug and the jack.

* * * * *